US010578110B2

(12) United States Patent
Husveg

(10) Patent No.: US 10,578,110 B2
(45) Date of Patent: Mar. 3, 2020

(54) CENTRIFUGAL PUMP WITH COALESCING EFFECT, DESIGN METHOD AND USE THEREOF

(71) Applicant: Typhonix AS, Bryne (NO)

(72) Inventor: Trygve Husveg, Varhaug (NO)

(73) Assignee: Typhonix AS, Bryne (NO)

( * ) Notice: Subject to any disclaimer, the term of this patent is extended or adjusted under 35 U.S.C. 154(b) by 662 days.

(21) Appl. No.: 14/758,918

(22) PCT Filed: Jan. 2, 2014

(86) PCT No.: PCT/EP2014/050021
§ 371 (c)(1),
(2) Date: Jul. 1, 2015

(87) PCT Pub. No.: WO2014/106635
PCT Pub. Date: Jul. 10, 2014

(65) Prior Publication Data

US 2015/0337842 A1 Nov. 26, 2015

(30) Foreign Application Priority Data

Jan. 4, 2013 (NO) ..... 20130021

(51) Int. Cl.

| | |
|---|---|
| ***F04D 1/06*** | (2006.01) |
| ***F04D 1/10*** | (2006.01) |
| ***F04D 7/04*** | (2006.01) |
| ***F04D 29/44*** | (2006.01) |
| ***F04D 31/00*** | (2006.01) |

(52) U.S. Cl.
CPC ..... *F04D 1/10* (2013.01); *F04D 1/06* (2013.01); *F04D 7/04* (2013.01); *F04D 7/045* (2013.01); *F04D 29/445* (2013.01); *F04D 31/00* (2013.01)

(58) Field of Classification Search
CPC . F04D 1/10; F04D 1/06; F04D 29/445; F04D 7/04; F04D 31/00
See application file for complete search history.

(56) References Cited

U.S. PATENT DOCUMENTS

| | | | | |
|---|---|---|---|---|
| 2,924,292 A * | 2/1960 | Hickman | ..... | F04D 19/046 202/182 |
| 3,643,516 A | 2/1972 | Jacobson | | |
| 6,345,503 B1 | 2/2002 | Gladden | | |
| 7,150,600 B1 | 12/2006 | Vennat | | |

(Continued)

FOREIGN PATENT DOCUMENTS

| | | |
|---|---|---|
| AT | 394136 | 2/1992 |
| CA | 2083069 A1 | 5/1994 |

(Continued)

OTHER PUBLICATIONS

De Verbigier, L., "International Search Report," prepared for PCT/EP2014/050021, dated Mar. 20, 2014, four pages.

*Primary Examiner* — Woody A Lee, Jr.
*Assistant Examiner* — Michael L Sehn
(74) *Attorney, Agent, or Firm* — Winstead PC

(57) ABSTRACT

The invention provides a centrifugal pump, distinctive in that the pump comprises two or more stages; the last stage in the direction of flow has been adapted so that it provides a larger equilibrium droplet size than the upstream stages. Method of designing the pump and use of the pump.

12 Claims, 6 Drawing Sheets

(56) References Cited

U.S. PATENT DOCUMENTS

| | | | | |
|---|---|---|---|---|
| 8,287,236 | B2 * | 10/2012 | Nishida | F04D 29/444 415/199.2 |
| 2003/0007871 | A1 | 1/2003 | McGinn et al. | |
| 2007/0183892 | A1 | 8/2007 | Sorokes | |
| 2009/0081031 | A1 | 3/2009 | Koopman et al. | |
| 2012/0057965 | A1 * | 3/2012 | Bergamini | F04D 3/00 415/143 |

FOREIGN PATENT DOCUMENTS

| | | | |
|---|---|---|---|
| CN | 2616720 | Y | 5/2004 |
| EP | 0648939 | B1 | 3/2003 |
| EP | 2423510 | A2 | 2/2012 |
| GB | 1520482 | A | 8/1978 |
| GB | 2023731 | A | 1/1980 |
| GB | 2414278 | A | 11/2005 |
| JP | 2001115981 | A | 4/2001 |
| SU | 1571298 | A1 | 6/1990 |
| WO | WO-2011101296 | A1 | 8/2011 |
| WO | WO-2013011105 | A2 | 1/2013 |

* cited by examiner

CENTRIFUGAL PUMP WITH COALESCING EFFECT, DESIGN METHOD AND USE THEREOF

FIELD OF THE INVENTION

The present invention relates to pumps for pressure boosting. More specifically, the invention relates to centrifugal pumps having high coalescing effect and low droplet breaking effect, meaning that the droplet size of a dispersed phase in a continuous phase can be increased or maintained, which can be favorable for subsequent process steps or the condition of the pumped medium. The pump can improve downstream separation steps, avoid creating of emulsions, avoid degradation of polymers and reduce the requirement for flocculants and coalescer type chemicals, emulsion breakers or surfactants.

BACKGROUND OF THE INVENTION AND PRIOR ART

For oil and condensate fields the pressure out from the well can be too low for effective processing, particularly toward tail production. In order to dump or reinject water separated out from the production flow, the oil contents must be reduced to a sufficiently low level. A pump can be required upstream of hydrocyclones or other separation equipment, in order to provide sufficient inlet pressure to the separator.

A problem not given much attention is that a pump can break up dispersed oil droplets to a size not feasible for effective separation in downstream separation equipment, thereby reducing the efficiency of the separation. Instead of considering the pump design in order to solve the problem, inserting a coalescer or injecting chemicals upstream the separator have been typical solutions.

A remote technical field for which low shear pumping is crucial, is the pumping of blood. However, the pressure and flow rates are not comparable or feasible for pressure boosting of oil, condensate, water or mixtures thereof.

The food industry comprises several processes for which low shear is feasible, for example pumping or transport of milk, other dairy products and emulsions. However, the pressure and flow rates typical for the food industry, for which the pumping is for short distance transport, make pumps for dairies and other food industry pumps unfeasible for pressure boosting of oil, condensate, water or mixtures thereof.

The objective of the present invention is to provide a pump able to provide coalescing effect, low droplet break up of a dispersed phase in a continuous phase, and relative high pressure boosting and high flow rate at the same time.

A number of more or less relevant prior art patent documents have been identified, namely: US 2003007871 A1, CA 2083069 A1, AT 394136 B, GB 1520482 A and U.S. Pat. No. 3,643,516 A. The above mentioned publications describe single stage pumps only, with one impeller or pumping stage. However, for some embodiments, the shape or design of the single impeller is adapted so as to provide low shear. Coalescing pumps are apparently not described.

No pumps having several stages or impellers with particular design of the last or successive impellers or stages so as to provide coalescing effect, low droplet break up, high pressure boosting and high flow rate at the same time have been identified. Multi stage pumps are traditionally made with identical impeller stages or stages that increase the pressure boosting but also the shear in the direction of flow, such as described in patent publication U.S. Pat. No. 7,150,600 B1, contrary to the teaching of the present invention.

SUMMARY OF THE INVENTION

The invention provides a centrifugal pump, distinctive in that the pump comprises two or more stages; the last stage in the direction of flow has been modified so that it provides a larger equilibrium droplet size than the upstream stages.

The term equilibrium droplet size means that the outlet droplet size from the stage will increase if the inlet droplet size of a dispersed fluid that is pumped is smaller than the equilibrium droplet size of the stage. And opposite, the outlet droplet size will decrease if the inlet droplet size in the fluid to the stage is larger than the equilibrium droplet size. If the inlet droplet size to the pump is equal to the equilibrium droplet size, the pressure will increase but the droplet size will remain equal. The droplet size is the average or median droplet size, consistently measured according to recognized standard methods like the one used in Malvern particle sizing instruments, for example the Malvern Insitec L In-Process Particle Sizer, or alternatively the MasterSizer S laboratory version. These instruments employ the Mie Theory as basis for droplet size calculations. Other theories and measurement principles are also available and commonly used in other instruments for droplet size measurements. The equilibrium droplet size varies with especially pump pressure and fluid residence time and is also affected by several factors related to pump design, which will be better understood from the description below. Several modifications are possible in order to achieve an increased equilibrium droplet size, which also will be better understood from the description below. The pump of the invention has a larger coalescing effect than prior art pumps, and a larger equilibrium droplet size, and will in many embodiments, modes of operation and inlet fluid compositions function as both a pump and a coalescer.

For a given required pressure boosting, the pump of the invention always comprises two, three or more stages, even if a single stage could provide sufficient pressure head. For pressure heads large enough to require two or more stages, the pump of the invention is distinctive in that the last stage, in the direction of flow, has been modified so as to provide increased equilibrium droplet size compared to the average of the upstream stages. To the contrary, prior art multi stage pumps provide equal or decreasing equilibrium droplet size in the last stage, which is related to equal or increasing shear, droplet break up and pressure head in the last stage compared to the upstream stages. The term stage or step means the combination of impeller and diffusor; however, the last stage may have a different diffusor design related to connection to the pump outlet.

Without wishing to be bound by theory, it is assumed that an impeller of a stage provides turbulence as a part of the process of pressure building. The turbulence is significant for the droplet collision rate, which is significant for the equilibrium droplet size. The turbulence may increase relatively more or faster than the pressure building. But turbulence is also related to droplet break up in the pump, having the opposite effect of droplet coalescence. Partly within the impeller but particularly when the pumped fluid reaches the diffusor, kinetic energy is converted to pressure energy whilst turbulence provides high droplet collision rate and thereby droplet coalescence and increased equilibrium droplet size. This assumes that inlet droplets to the pump stage are smaller than the stage's equilibrium droplet size. This also assumes the flow velocity in the diffuser does not become too low which would result in diminishing turbulence and low droplet collision rates. Compared to prior art multi stage pumps, which may have low shear effect on the pumped fluid compared to a single stage pump, the pump of the invention provides increased coalescence and further reduced shear, and thereby increased equilibrium droplet size, by modifying successive impellers or diffusors or both.

The pump of the invention provides coalescing effect, low droplet break up of a dispersed phase in a continuous phase, high pressure boosting and high flow rate at the same time. Some embodiments of the pump of the invention will be further described below.

For pumps of the invention, the pressure head of a pump stage decreases in the direction of flow, the pressure head decreases for each subsequent stage or group of subsequent stages. Preferably this is achieved by having smaller impeller diameter of a stage in the direction of flow, the diameter of subsequent impellers decreases for each subsequent impeller or group of subsequent impellers. For example, if the pump comprises three impellers, the first impeller, at the inlet, is larger in diameter than the second impeller which is larger than the third impeller. Alternatively, the axial flow component of an impeller of a stage increases relative to the radial flow component, for subsequent stages in the direction of flow, the axial flow component increases for each subsequent impeller or group of subsequent impellers. The pressure builds up increasingly radial out on the impeller blades in a centrifugal pump, accordingly, more axial flow direction decreases the pressure build up.

Preferably, the pump comprises a diffusor of increased or more increasing cross section area for flow relative to standard diffusors, preferably not at the diffuser inlet toward the impeller but toward the diffuser outlet toward the next impeller or the pump outlet. This means that the diffusor has enlarged flow bore or conduit cross section area relative to standard diffusor design for converting kinetic fluid energy to pressure energy, by at least 10%, preferably 50%, more preferably over 100%, such as 500-800%, toward the downstream end of the diffusor. This means that the residence time increases and accordingly the droplet coalescing increases. The turbulence causes droplets to collide and coalesce; this process will work for a longer period of time with a diffuser having larger flow cross section and hence longer residence time. In addition or alternatively to an increased cross section flow diameter, the diffusor conduit is preferably longer than conventional. In the most preferable embodiment of a diffusor for a pump of the invention, the diffusor is longer and the last part of the diffusor cross section becomes wider and wider, compared to typical diffusor design.

Preferable embodiments of the pump of the invention has been modified by modifying impellers, diffusors or both impellers and diffusors, in that impellers have been modified by one or more of the features: reduced impeller diameter for subsequent stages; chosen or modified impellers so as to provide increased impeller axial flow component relative to radial flow component, a step down gear upstream the last stage or stages providing reduced rotational speed, or using one of the impeller designs known for low turbulence or shear in the last stage, and diffusors have been modified by one or more of the features for increased residence time of the fluid in the diffusor whilst turbulence provides increased droplet collisions; by increased length of flow through the diffusor; increased or increasing cross section area for flow through the diffusor.

Preferably, the pump impellers are arranged on a common shaft. Alternatively, two or more shafts are included, optionally coupled with a gear. The gear can be a step down gear, which will provide a pump of the invention even without changing the design of the last impeller or stage. An embodiment of a pump of the invention comprises one of the above referred to previously known low shear impellers as the last stage impeller. Some relevant prior art impellers for the last stage are described in the patent publications mentioned in the introduction, to which publications reference is made for guidance.

The invention also provides a method of designing a pump for a given pressure head so as to mitigate downstream separation processes, distinctive by dividing the pump into two, three or more pump stages, and modifying or choosing the last stage in the direction of flow so that it has a larger equilibrium droplet size than the upstream stages.

Preferably, impellers, diffusors or both impellers and diffusors are modified.

More specifically, impellers are modified by one or more of the steps: reducing the impeller diameter for subsequent stages; choosing or modifying impellers so as to provide reduced turbulence by providing more axial impeller flow, operating the last stages at reduced rotational speed by inserting a step down gear upstream the last stage or stages, or using one of the impeller designs known for low shear in the last stage, and diffusors are modified by one or more of the steps: increasing the residence time of the fluid in the diffusor whilst turbulence provides increased droplet collisions, by increasing the length of flow through the diffusor, increasing the cross section area for flow through the diffusor, or both increasing said length and cross section area of the diffusor.

The pump of the invention can in principle pump any pumpable liquid or mixture of liquids, and also mixtures of liquid with some gas. However, in order to take the full advantage of the pump it is advisable for pumping of liquid mixtures where a dispersed liquid is distributed as droplets in a continuous liquid, such as oil droplets in produced water, water droplets in oil, for which downstream separation will be facilitated; and emulsions, polymers and mixtures sensitive to shear and droplet or emulsion break up, for example polymers for enhanced oil recovery.

Accordingly, the invention also provides use of a pump of the invention, for pressure boosting of shear sensitive fluids, such as liquid mixtures upstream separation equipment. Typical fluid or liquid mixtures are any dispersed phase in a continuous phase. Oil in water pumping, and also water in oil pumping, are very relevant fields of use, particularly upstream separators. Further uses of the invention, are the pumping of polymer solutions for injection into reservoirs for enhanced oil recovery and pumping of shear sensitive production chemicals. Pumping in the food industry is also included, for example pumping mayonnaise, other emulsions, milk, butter or cream. Also, pumping of paint and other chemical emulsions are included fields of use where the pump of the invention can be beneficial.

Further, the invention provides use of a two or further stages centrifugal pump, for pressure boosting, at pressure heads where a one stage or a fewer stage pump would be used according to the knowledge of a person of ordinary skill in the art, whereby droplet coalescence or less droplet break up than expected takes place. This means use of not only the pumps of the invention, which have been modified, but also of regular two or multi stage pumps, but using a pump having more stages than considered beneficial for the actual pressure boosting or pressure head.

FIGURES

The invention is illustrated with six figures, of which:

DETAILED DESCRIPTION

Figure 1:
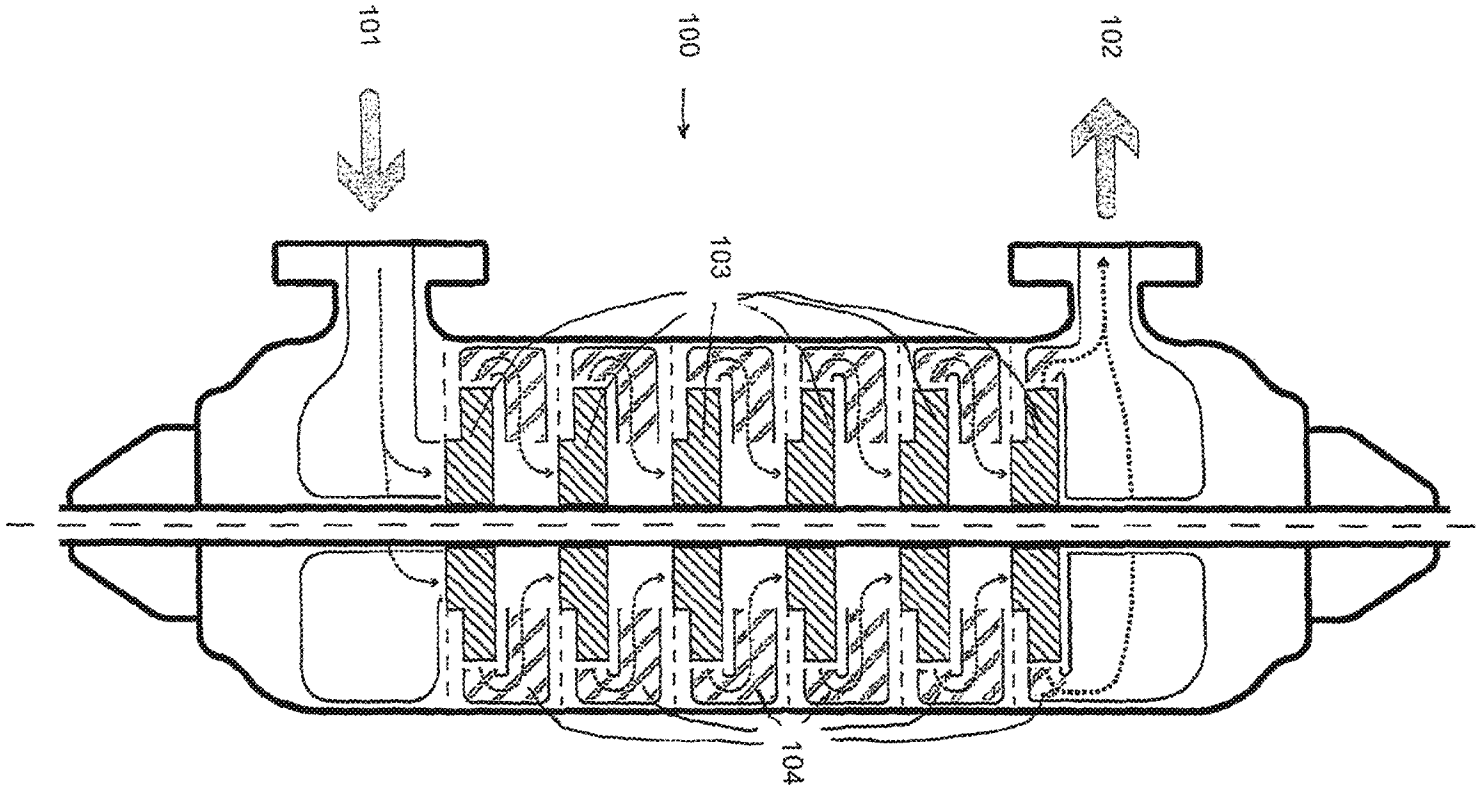
FIG. 1 illustrates a prior art pump.

Reference is first made to FIG. 1, illustrating a prior art multi stage centrifugal pump 100, comprising an inlet 101, an outlet 102, six impellers 103 and diffusors 104 arranged between the impellers and downstream the last impeller. The impellers 103, having identical diameters, are hatched with one type of filling for all impellers. Likewise, the diffusors 104 are hatched with one type of filling for all diffusors. With this typical design, all impellers are identical and all diffusors between the impellers are identical. Dotted lines and arrows indicate the fluid path through the pump.

Figure 2:
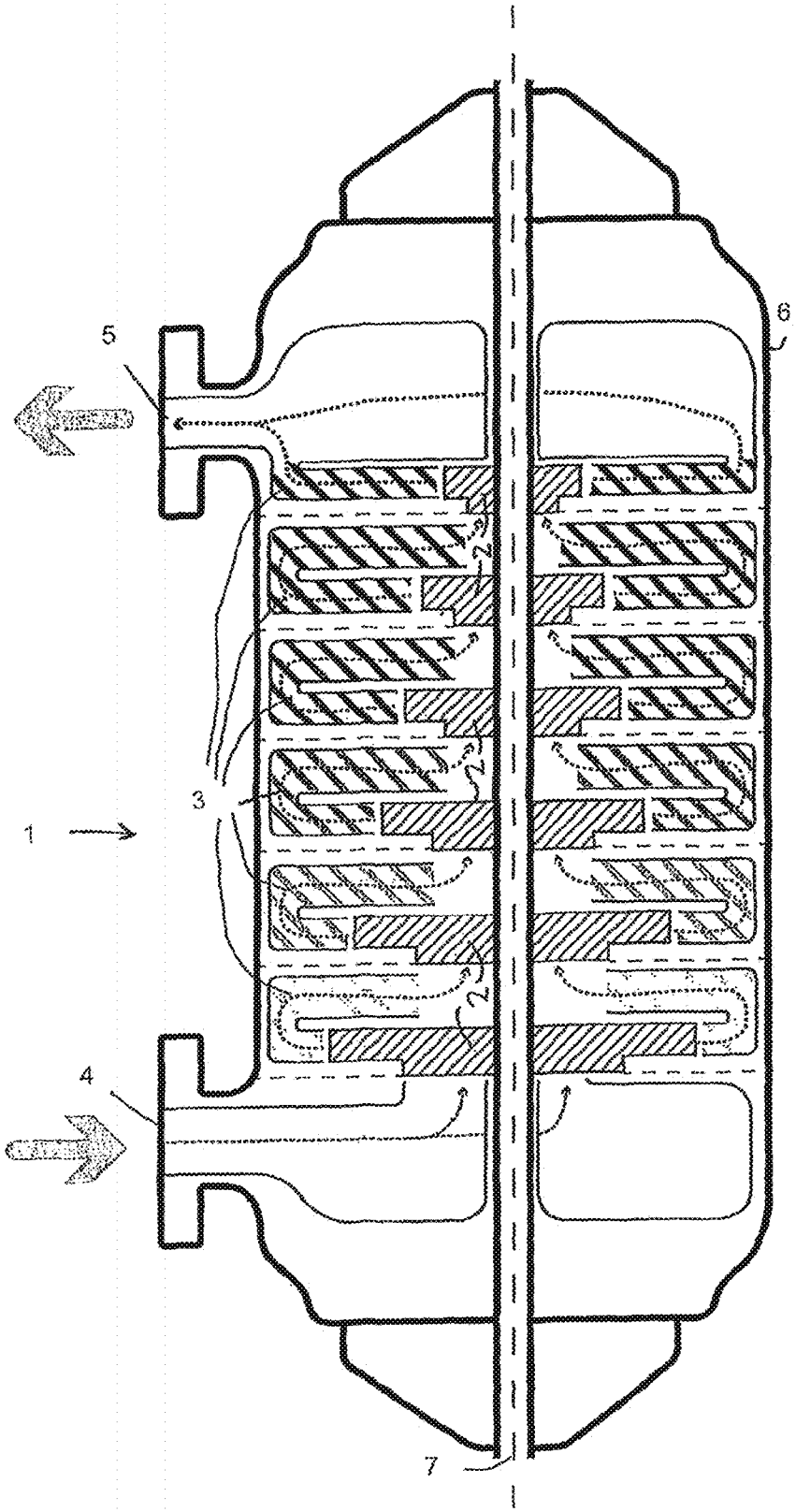
FIG. 2 illustrates a pump of the invention.

Reference is then made to FIG. 2, illustrating a centrifugal pump 1 of the invention, comprising six impellers 2 and diffusors 3 arranged between the impellers, and after or downstream the last impeller a diffusor section is arranged toward the outlet 5. The further parts of the pump 1, such as inlet 4, outlet 5, housing 6 and connection to a driving shaft 7, are according to prior art and assumed to be well known for persons skilled in the art, for which reason only the novel features will be described in detail. The distinctive feature of the pump of the invention is that the ultimate stage, step or impeller in the direction of flow provides a larger equilibrium droplet size than the upstream stage, step or impeller, by providing pressure boosting with coalescing effect and low shear. In the illustrated embodiment, the impellers decrease in diameter toward the outlet, whilst the diffusors between the impellers increase in size/volume toward the outlet. The impellers become successively smaller in diameter, the diffusors increase correspondingly, filling up the increased space between the housing and shaft whilst enhancing coalescence by prolonging the residence time of fluid in said diffusor.

Figure 3:
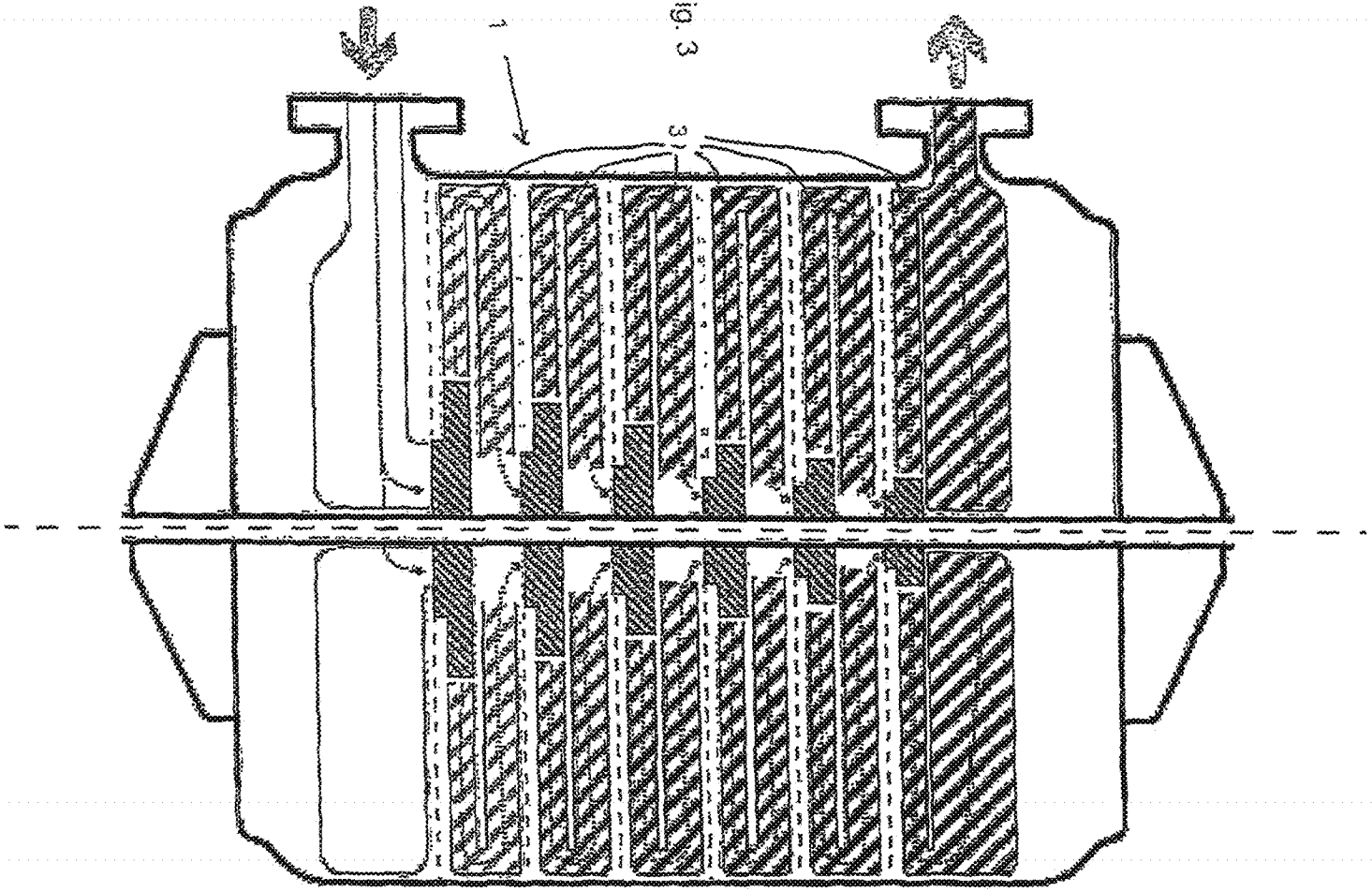
FIG. 3 illustrates another pump of the invention.

Reference is made to FIG. 3, illustrating a further embodiment of a pump 1 of the invention. More specifically, this embodiment also comprises successively smaller diameter impellers 2 for each stage, and successively larger diffusors 3 for each stage. The housing diameter, impeller diameters and diffusor diameters are larger than for the embodiment illustrated in FIG. 2, which can allow a higher coalescing effect for each stage. The ultimate diffusor, which is the diffusor coupled to the outlet, has significantly increased residence time of the pumped fluid, by increased outlet channel cross section area and length. The pump illustrated in FIG. 3 provides an enhanced equilibrium droplet size over the embodiment illustrated in FIG. 2, by enhanced coalescence due to increased number of droplet collisions in the diffusors because of longer fluid residence time.

The impellers, diffusors or both, can be modified or selected in many ways for providing a pump of the invention, as described above and below.

Figure 4:
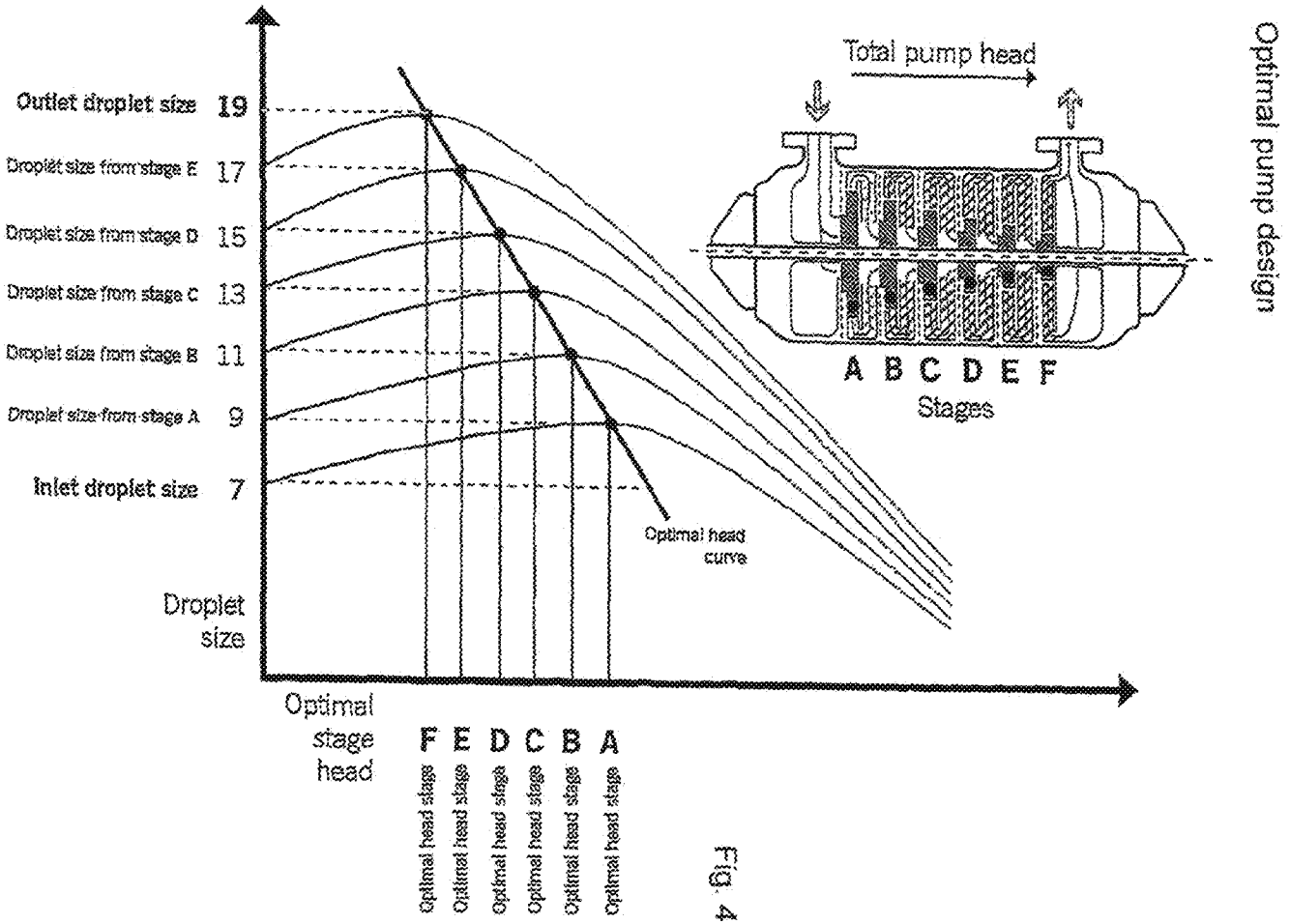
FIG. 4 illustrates optimal pump design according to the invention.

Reference is made to FIG. 4, illustrating a method of optimal pump design of the invention, for designing a pump of the invention by varying the impeller diameter. The Y-axis denotes the actual inlet droplet size in the continuous phase, in this case oil droplets in produced water. The X-axis denotes pump stage pressure head. In this example, the inlet droplet size is 7 μm, as indicated by a lower continuous line start point and text on the Y-axis. When the fluid flows through the first stage, pressure is built up while at the same time the droplet size increases up to a certain level, seen as the continuous line starting from 7 μm on the Y-axis and increasing to a top of the line or curve, corresponding to about 9 μm droplet size at higher pressure. The top point indicates the optimal stage pressure head A, corresponding to a particular first stage impeller diameter A as indicated. The first stage impeller is the largest diameter impeller. The outlet from the first stage is produced water with oil droplet size of 9 μm, corresponding to a new line in FIG. 4, starting at 9 μm on the Y-axis and providing a further droplet size increase and further pressure head, as found at the top point B of the curve, and corresponding to a smaller diameter impeller B of the second stage, also indicated in the figure. More specifically, each subsequent stage comprises a smaller diameter impeller, delivering reduced pressure head but increased equilibrium droplet size. An optimal head curve indicates how this is related for pumps of the invention by varying the impeller stage diameter for a specific type of impeller. Similar methods can be used, alone or in combinations, for varying other parameters, such as diffusor length or width or residence time, impeller design (from radial toward axial from inlet toward outlet) and other methods, which are discussed in this document and also represents embodiments of the invention.

Without wishing to be bound by theory, it is assumed that each pump stage or pump provides an equilibrium droplet size for a particular type of inlet fluid mixture. If the inlet droplet size is sufficiently small, the droplet size will increase whilst the pressure increase. If the inlet droplet size is larger than the equilibrium droplet size, the pressure will increase but the droplet size will decrease. If the inlet droplet size is equal to the equilibrium droplet size, the pressure will increase but the droplet size will remain equal. The droplet size is the average or median droplet size.

Figure 5:
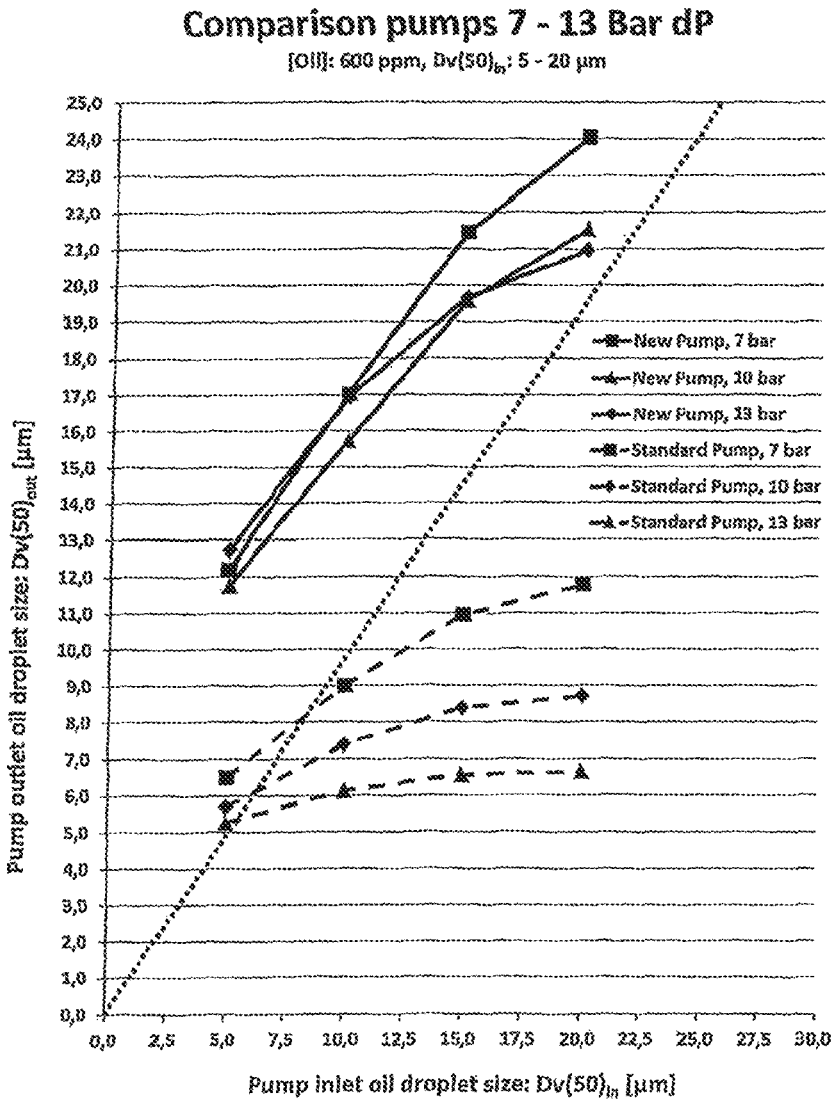
FIG. 5 illustrates the technical effect of the invention.

Reference is made to FIG. 5, illustrating comparison results for pumps of the invention compared to prior art pumps. More specifically, the applicant has tested conventional pumps in the laboratory, pumps which are typically used in various produced water applications. FIG. 5 is a diagram showing the effects on oil droplet sizes from the various pumps at different pump differential pressures. In this comparative study the following pumps were used:

1. New Pump: A centrifugal pump according to the invention.
2. Standard Pump: A conventional single-stage centrifugal pump.

The diagram of FIG. 5 shows the various pumps' outlet droplet sizes in μm on the y-axis, represented by Dv(50), as a function of inlet droplet sizes on the x-axis for three different pump differential pressures; 7, 10, and 13 bars, respectively. The black, dotted diagonal line illustrates when outlet droplets equal inlet droplets in size. Again, this signifies that results above the dotted line imply that the net effect of the pump is oil droplet enlargement while results below the line dotted line means that the net effect is oil droplet breaking. The results may be summarized as follows:

A pump according to the invention clearly provides the best oil droplet performance when compared to the single-stage centrifugal pump. The outlet oil droplet sizes are always larger for the pumps of the invention.

Not illustrated, extensive comparative testing against prior art multi stage pumps and also screw pumps has been undertaken. Standard multi stage centrifugal pumps or single stage centrifugal pumps are never close in performance, only screw pumps are comparable for some embodiments, but only for the large inlet droplet sizes 15 and 20 μm where downstream separation processes usually will function as intended anyway.

Figure 6:
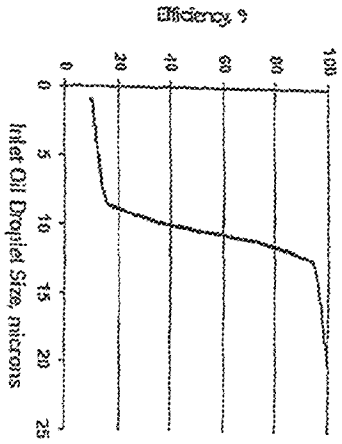
FIG. 6 illustrates the effect of droplet size for a downstream separator.

Reference is made to FIG. 6, indicating typical separation effect of a deoiling hydrocyclone. At droplet sizes from about 13 μm to 9 μm, the separation effect drops dramatically, from about 95% to about 17%. If the inlet pressure to a hydrocyclone must be raised for effective operation, using a pump of the invention can be essential for a good result. Compared to a screw pump, the multi stage centrifugal pump of the invention is small and energy effective.

The pumps of the invention provides the required pressure head by modifying the pump so as to have a decreasing pressure head toward the outlet, by one or more of the features: decreasing the impeller diameter, enlarging the diffusor, reducing speed for subsequent inpeller stages, modifying subsequent impellers toward more axial flow on behalf of radial flow, or additional features discussed herein. The result is a droplet coalescense, if the inlet fluid droplet size is smaller than the quilibrium droplet size, or less droplet break up, if the inlet fluid droplet size is larger than the equilibrium droplet size. Some multiphase pumps or gas tolerant pumps, as well as compressors, may have a smaller flow bore at subsequent impellers, or even a smaller impeller size, however, this has only to do with the gas being compressed and requiring less space, it has nothing to do with coalescence, reduced droplet break up or facilitating subsequent separation.

The invention claimed is:

1. A centrifugal pump, the centrifugal pump configured to operate in two or more stages, each stage comprising:

at least one combined impeller and a diffusor, the impeller being arranged upstream relative to the diffusor;

an impeller of the last stage of the two or more stages in the direction of flow, relative to an upstream stage impeller, comprising at least one of the following features:

an impeller-flow-conduit inlet at equal distance from a rotation shaft; and a reduced impeller outer diameter compared to upstream stage impellers combined with an impeller-flow-conduit outlet having an increased axial flow direction component and a reduced radial flow direction component relative to the upstream stage impellers; and a step down gear upstream the last stage for providing reduced rotational speed; and a diffusor of the last stage of the two or more stages in the direction of flow, relative to an upstream stage diffusor, comprising at least one of the following features:

increased diffusor flow-conduit length combined with increased or increasing diffusor flow conduit cross-sectional area.

2. The centrifugal pump according to claim 1, comprising:

a housing having a constant diameter;

a last stage impeller-flow-conduit inlet at equal distance from the rotation shaft as for upstream impellers combined with a last stage impeller-reduced-outer diameter; and a diffusor having increased diffusor-flow-conduit length extending from the upstream impeller-flow-conduit outlet outwards to the housing from where the diffusor flow conduit turns and extends inwards to the next impeller flow conduit inlet or to a pump outlet.

3. The centrifugal pump according to claim 1, wherein the impeller outer diameter decreases for each subsequent stage.

4. The centrifugal pump according to claim 1, comprising:

an impeller with a flow-conduit outlet having an increased axial-flow-direction component and a reduced radial-flow-direction component in the last stage relative to an upstream stage impeller-flow-conduit outlet.

5. A method of designing or modifying a pump for a given pressure head to mitigate downstream separation processes, the method comprising:

dividing the pump into two or more stages, each stage comprising at least one combined impeller and a diffusor, the impeller being arranged upstream relative to the diffusor;

designing or modifying a last stage of the pump in a direction of flow to comprise at least one of the following features:

an impeller having an impeller-flow-conduit inlet at equal distance from a rotation shaft and a reduced impeller outer diameter compared to upstream stage impellers combined with an impeller-flow-conduit outlet having an increased axial flow direction component and a reduced radial flow direction component relative to the upstream stage impellers; and a step down gear upstream the last stage for providing reduced rotational speed; and designing or modifying the last stage of the pump in the direction of flow to comprise at least one of the following features:

a diffusor having increased diffusor flow-conduit length combined with increased or increasing diffusor flow conduit cross-sectional area compared to upstream stage diffusors.

6. The method according to claim 5, wherein the pump comprises:

a housing having a constant diameter;

a last stage impeller-flow-conduit inlet at equal distance from the rotation shaft as for upstream impellers combined with a last stage impeller-reduced-outer diameter; and a diffusor having increased diffusor-flow-conduit length by arranging the diffusor-flow-conduit from the upstream impeller-flow-conduit outlet outwards to the housing from where the diffusor-flow-conduit turns and extends inwards to the next impeller-flow-conduit inlet or is directed to a pump outlet.

7. A centrifugal pump, the centrifugal pump configured to operate in two or more stages, each stage comprising:

at least one combined impeller and a diffusor, the impeller being arranged upstream relative to the diffusor;

an impeller of the last stage of the two or more stages in the direction of flow, relative to an upstream stage impeller, comprising at least one of the following features:

an impeller-flow-conduit inlet at equal distance from a rotation shaft and a reduced impeller outer diameter compared to upstream stage impellers;

an impeller flow-conduit outlet having an increased axial flow direction component and a reduced radial flow direction component relative to the upstream stage impellers; and a diffusor of the last stage of the two or more stages in the direction of flow, relative to an upstream stage diffusor, comprising at least one of the following features:

increased diffusor flow-conduit length; and increased or increasing diffusor flow conduit cross-sectional area.

8. The centrifugal pump according to claim 7, comprising:

a housing having a constant diameter;

a last stage impeller-flow-conduit inlet at equal distance from a rotation shaft as for upstream impellers combined with a last stage impeller-reduced-outer diameter; and a diffusor having increased diffusor-flow-conduit length extending from the upstream impeller-flow-conduit outlet outwards to the housing from where the diffusor flow conduit turns and extends inwards to the next impeller flow conduit inlet or to a pump outlet.

9. A method of designing or modifying a pump for a given pressure head to mitigate downstream separation processes, the method comprising:

dividing the pump into two or more stages, each stage comprising at least one combined impeller and a diffusor, the impeller being arranged upstream relative to the diffusor;

designing or modifying a last stage of the pump in the direction of flow to comprise at least one of the following features:

an impeller having an impeller-flow-conduit inlet at equal distance from a rotation shaft and a reduced impeller outer diameter, compared to upstream stage impellers;

an impeller having an impeller-flow-conduit outlet having an increased axial flow direction component and a reduced radial flow direction component, relative to the upstream stage impellers; and designing or modifying the last stage of the pump in the direction of flow to comprise at least one of the following features:

a diffusor having an increased diffusor flow-conduit length compared to upstream stage diffusors, and a diffusor having increased or increasing diffusor flow conduit cross-sectional area compared to the upstream stage diffusors.

10. The method according to claim 9, wherein:

the pump is designed with a constant diameter housing having a last stage impeller-flow-conduit inlet at equal distance from a rotation shaft as for upstream impellers combined with a last stage impeller-reduced-outer diameter; and a diffusor having increased diffusor-flow-conduit length by arranging the diffusor-flow-conduit from the upstream impeller-flow-conduit outlet outwards to the housing from where the diffusor-flow-conduit turns and extends inwards to the next impeller-flow-conduit inlet or is directed to a pump outlet.

11. A centrifugal pump configured to operate in two or more stages, the pump comprising:

a housing having a constant diameter;

wherein each stage comprises at least one combined impeller and a diffusor, the impeller being arranged upstream relative to the diffusor;

an impeller of the last stage of the two or more stages in the direction of flow, relative to an upstream stage impeller, comprises an impeller-flow-conduit inlet at equal distance from a rotation shaft and a reduced impeller outer diameter compared to upstream stage impellers; and a diffusor of the last stage of the two or more stages in the direction of flow, relative to an upstream stage diffusor, comprises increased diffusor-flow-conduit length extending from the upstream impeller-flow-conduit outlet outwards to the housing from where the diffusor flow conduit turns and extends inwards to the next impeller flow conduit inlet or to a pump outlet.

12. A centrifugal pump configured to operate in two or more stages, the pump comprising:

a housing having a constant diameter;

wherein each stage comprises at least one combined impeller and a diffusor, the impeller being arranged upstream relative to the diffusor;

wherein a last stage of the two or more stages in the direction of flow comprises:

an impeller having an impeller-flow-conduit inlet at equal distance from a rotation shaft and a reduced impeller outer diameter compared to upstream stage impellers; and a diffusor having increased diffusor-flow-conduit length extending from the upstream impeller-flow-conduit outlet outwards to the housing from where the diffusor flow conduit turns and extends inwards to the next impeller flow conduit inlet or to a pump outlet.

* * * * *